US010945535B2

(12) United States Patent
Roberts et al.

(10) Patent No.: US 10,945,535 B2
(45) Date of Patent: Mar. 16, 2021

(54) MULTI-STAGE INFANT ACTIVITY CENTER

(71) Applicant: Summer Infant (USA), Inc., Woonsocket, RI (US)

(72) Inventors: Luke Roberts, North Smithfield, RI (US); Anthony Carbone, Harrisville, RI (US)

(73) Assignee: Summer Infant (USA), Inc., Woonsocket, RI (US)

( * ) Notice: Subject to any disclaimer, the term of this patent is extended or adjusted under 35 U.S.C. 154(b) by 72 days.

(21) Appl. No.: 16/167,210

(22) Filed: Oct. 22, 2018

(65) Prior Publication Data

US 2019/0116988 A1 Apr. 25, 2019

Related U.S. Application Data

(60) Provisional application No. 62/575,576, filed on Oct. 23, 2017.

(51) Int. Cl.

| | |
|---|---|
| ***A47D 1/00*** | (2006.01) |
| ***A47D 15/00*** | (2006.01) |
| ***A47D 1/10*** | (2006.01) |
| ***A47D 11/00*** | (2006.01) |

(52) U.S. Cl.

CPC ..... *A47D 1/0085* (2017.05); *A47D 1/0081* (2017.05); *A47D 1/103* (2013.01); *A47D 11/00* (2013.01); *A47D 15/00* (2013.01); *A47D 15/006* (2013.01)

(58) Field of Classification Search

None

See application file for complete search history.

(56) References Cited

U.S. PATENT DOCUMENTS

| | | | | |
|---|---|---|---|---|
| 3,109,666 | A | 11/1963 | James | |
| 3,258,291 | A | 6/1966 | Zacharie | |
| 3,567,275 | A | 3/1971 | Bukey | |
| 4,620,711 | A | 11/1986 | Dick | |
| 5,855,384 | A | 1/1999 | Pike et al. | |
| 8,104,780 | B1 * | 1/2012 | McConnell-Copploe | A47D 13/043 280/87.051 |
| 9,365,231 | B1 * | 6/2016 | Rajput | B62B 7/08 |
| 2002/0027382 | A1 * | 3/2002 | Bellows | A63H 33/00 297/135 |
| 2002/0036416 | A1 * | 3/2002 | Mendenhall | A47D 15/00 297/148 |
| 2012/0261957 | A1 * | 10/2012 | Tadin | A47D 3/001 297/250.1 |
| 2013/0319884 | A1 * | 12/2013 | Gomez | A47D 1/103 206/216 |

(Continued)

OTHER PUBLICATIONS

Amazon.com, Summer Infant 3-Stage SuperSeat, date unknown, 9 pages.

*Primary Examiner* — David R Dunn
*Assistant Examiner* — Christopher E Veraa
(74) *Attorney, Agent, or Firm* — Adler Pollock & Sheehan P.C

(57) ABSTRACT

An apparatus includes a hard plastic booster seat, a soft foam insert positioned inside the hard plastic booster seat, and a semi-circular tray removeably affixed to an upper channel of a top portion of the hard plastic booster seat, the tray comprising one or more sections configured to be locked separately or in combination into the upper channel with a dual function latch mechanism.

11 Claims, 8 Drawing Sheets

(56) References Cited

U.S. PATENT DOCUMENTS

| | | | | |
|---|---|---|---|---|
| 2014/0368004 | A1* | 12/2014 | Sclare | A47D 1/10<br>297/135 |
| 2016/0106229 | A1* | 4/2016 | Speer | A47D 1/008<br>446/227 |
| 2016/0174727 | A1* | 6/2016 | Haut | A47D 1/106<br>297/130 |
| 2017/0119172 | A1* | 5/2017 | Sclare | A47D 1/0083 |
| 2017/0232355 | A1* | 8/2017 | Healy | A47D 3/001<br>446/227 |
| 2018/0035824 | A1* | 2/2018 | Goh | H01M 4/505 |

* cited by examiner

MULTI-STAGE INFANT ACTIVITY CENTER

CROSS REFERENCE TO RELATED APPLICATIONS

This application claims benefit from U.S. Provisional Patent Application Ser. No. 62/575,576, filed Oct. 23, 2017, which is incorporated by reference in its entirety.

STATEMENT REGARDING GOVERNMENT INTEREST

None.

BACKGROUND OF THE INVENTION

The invention generally relates to booster-type seats, and in particular, to a multi-stage infant activity center.

In general, a booster seat is a firm cushion of foam or plastic that raises and supports a young child higher. Booster seats are often configured to be mounted on or resting on the seat bottom of a conventional chair. A child is then seated in the booster seat, raising the child higher up than if seated directly on the chair set bottom. Sometimes, the booster seat may be provided with its own dedicated tray to provide the child with an eating or play surface while seated in the booster seat. As a child ages, the type of booster seat requires changes to adapt to the growing child.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In an aspect, the invention features an apparatus including a hard plastic booster seat, a soft foam insert positioned inside the hard plastic booster seat, and a semi-circular tray removeably affixed to an upper channel of a top portion of the hard plastic booster seat, the tray comprising one or more sections configured to be locked separately or in combination into the upper channel with a dual function latch mechanism.

In another aspect, the invention features an apparatus including a solid base, a soft insert configured to fit within the base, a harness affixed to the solid base and passing through a center of the soft insert, and a removable tray slideably fixated in an outer channel of an upper portion of the solid base and secured by a dual function latch mechanism.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
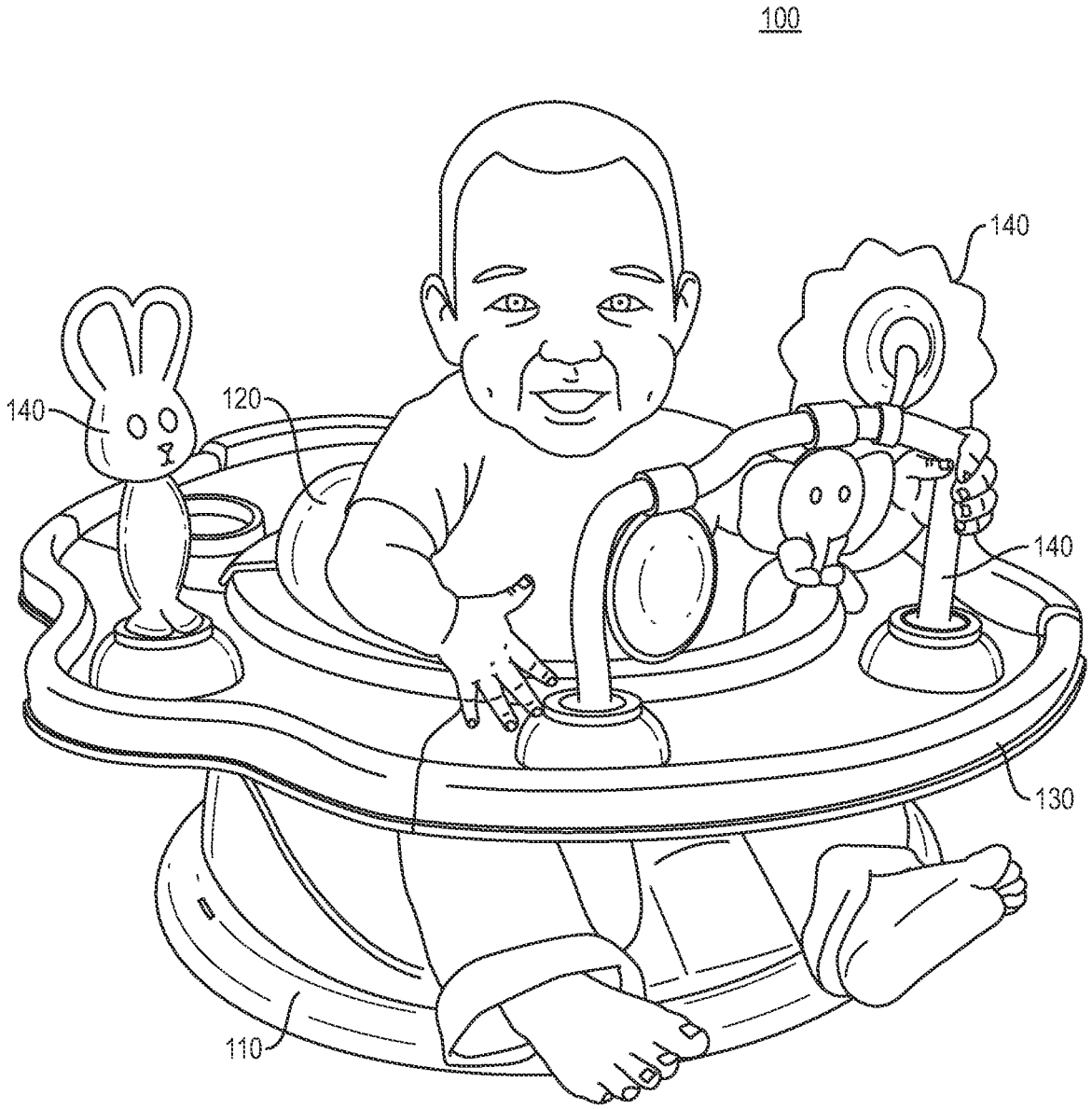
FIG. 1 is diagram of an exemplary multi-stage infant activity center.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The present disclosure is directed to a multi-stage infant activity center that provides 360 degrees of floor time activity fun and booster in one. The multi-stage infant activity center is a secure and comfortable area for a growing infant to learn to sit up and interact with their environment around them. With the multi-stage infant activity center a baby can experience play while also sitting up. The multi-stage infant activity center is an ideal place to keep a baby entertained, safe and happy.

As shown in FIG. 1, an exemplary multi-stage infant activity center 100 includes a base 110, a soft foam insert 120 and a tray 130. This configuration is referred to herein as "stage 2." Stage 2 represents the multi-stage infant activity center 100 as an activity center with playful toys to keep a child entertained. The tray 130 shown includes one or more optional play items 140. The tray 130 is attached to the base 110 with a latching mechanism, fully described below, designed insure the tray 130 remains slideably fixated to the base 110 yet providing an ability for the attached tray 130 to rotate 360 degrees around the base 110 such that each of the items 140 come into a view of a child sitting within the multi-stage infant activity center 100. In addition, the latching mechanism enables a play section of the tray 130 to be removed, leaving a feeding component of the tray 130 up front. With this feature, the multi-stage infant activity center 100 can be used as a booster seat with a feeding tray in front, similar to a high chair.

Figure 2:
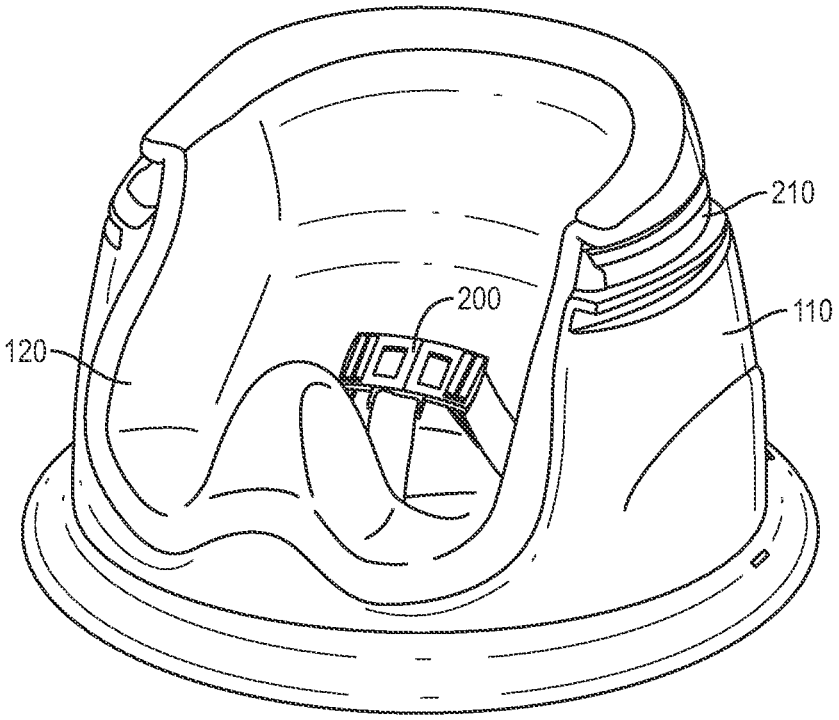
FIG. 2 is a diagram of stages of the multi-stage infant activity center of FIG. 1.

Referring to FIG. 2, the multi-stage infant activity center 100 (of FIG. 1) is shown with the tray 130 removed. This configuration is referred to herein as "stage 1." The stage 1 configuration includes the base 110 and the soft foam insert 120. Once a baby can hold up his or her head unassisted, the stage 1 functions as an infant support seat. The soft foam insert 120 offers additional support and removes easily from the base 110 as the baby grows. An adjustable three-point harness 200 keeps the child securely in place. The base 100 acts as a seat structure and is constructed of materials such as light weight plastic. The infant can sit on the soft foam insert 120 in the base 100 and in the base 100 alone when not needed and the soft foam insert 120 is removed. The three-point harness 200 is secured to the base 100 and therefore available to secure the child whether or not the soft foam insert 120 is used.

A channel 210 surrounds an upper portion of the base 100. The channel 210 is designed to mate with an inner perimeter of the tray 130, enabling the attached tray 130 to rotate 360 degrees about the base 100. In addition, the channel 210 includes the locking mechanism, which enables tray 130 rotation and tray 130 locking (i.e., to prevent rotation).

Figure 3:
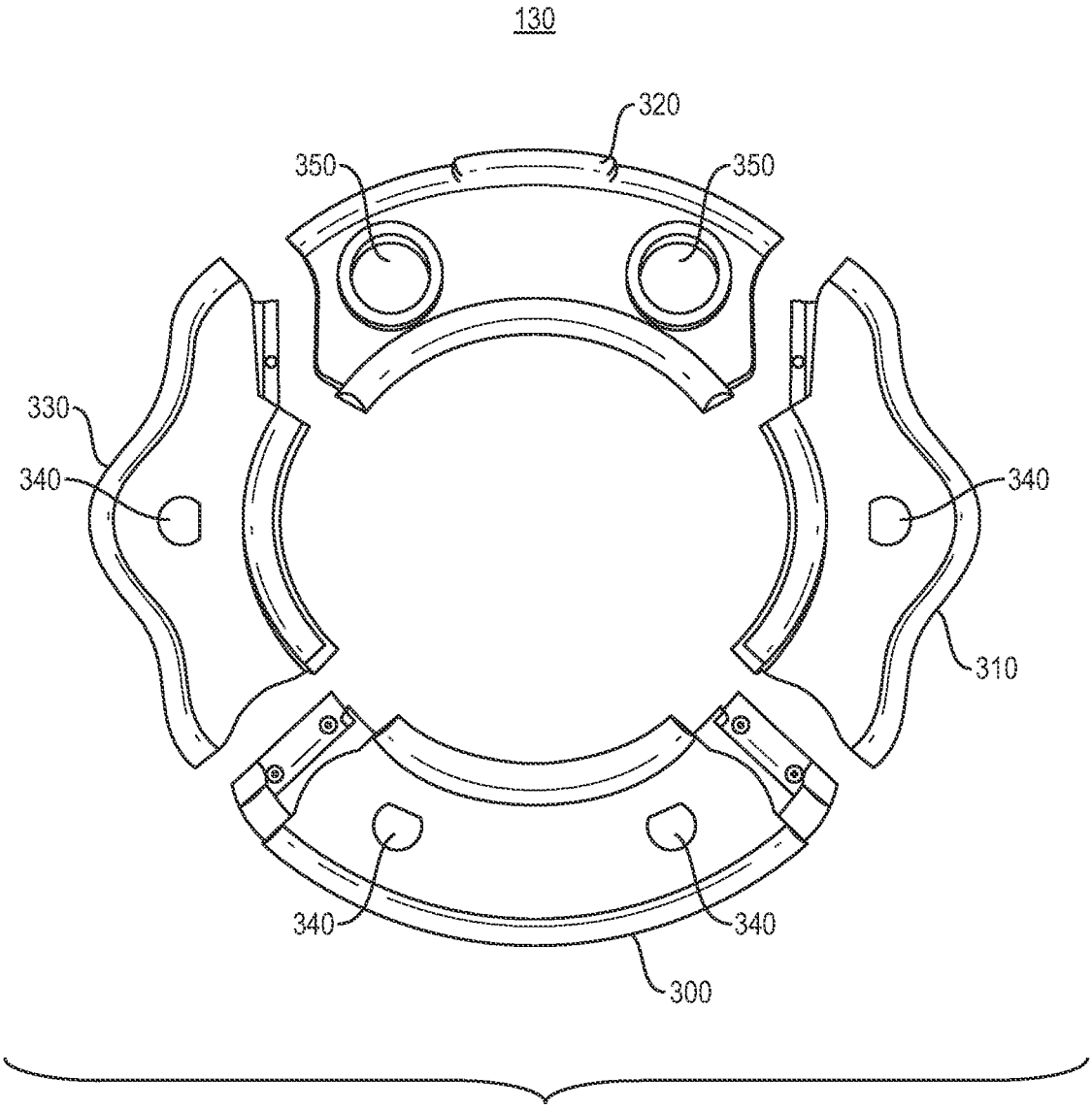
FIG. 3 is a diagram of an exemplary tray of the multi-stage infant activity center of FIG. 1.

Referring now to FIG. 3, one embodiment of the tray 130 is shown to include four inter-locking tray sections 300, 310, 320, 330. When the tray sections 300, 310, 320, 330 are secured together, an inner perimeter of the assembled tray 130 is sized to mate with the channel 210 of the base 100.

In the embodiment shown in FIG. 3, sections 300, 310, 330 include one or more apertures 340 that are designed to secure the one or more items 140. In addition, section 320 is shown to include two cup holder punch outs 350 that are configured to secure one or more containers, such as a milk or juice bottle, for example.

Figure 4:
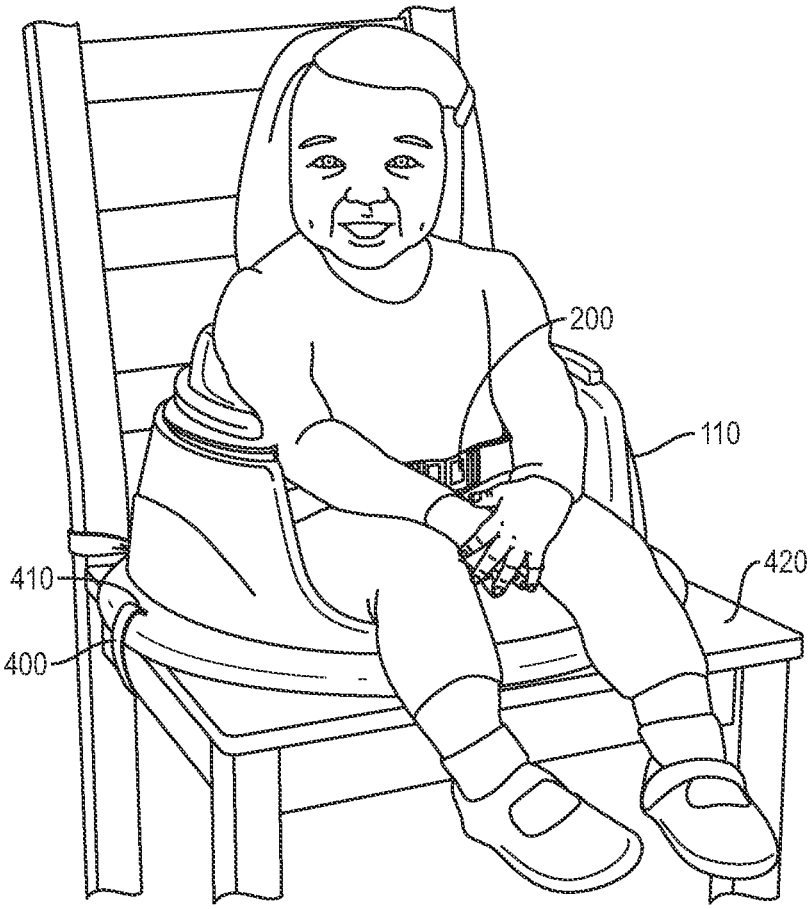
FIG. 4 is a diagram of a stage of the multi-stage infant activity center of FIG. 1.

As shown in FIG. 4, a "stage 3" configuration of the multi-stage infant activity center 100 includes only the base 100 and the adjustable three-point harness 200 with the insert 120 and tray 130 removed. Additionally, a securing strap or band 400 is placed through lower apertures 410 in a lower portion of the base 110 to secure the base 110 to a chair 420.

The stage 3 configuration transforms the multi-stage infant activity center 100 into a booster-type seat for eating at a table. The chair straps 400 enable secure positioning to any standard chair. The lightweight base 100 is also portable so one can take it to a restaurant or on a play date. Moreover, in another embodiment, the latching mechanism may be used to form a type of high chair. More specifically, the tray 130 may be removed from the base 110 and disassembled. A portion of the tray 130, such as section 320, may then be attached to the base 110. This results in leaving a feeding component of the base 110 up front and resembles a high chair.

Figure 5:
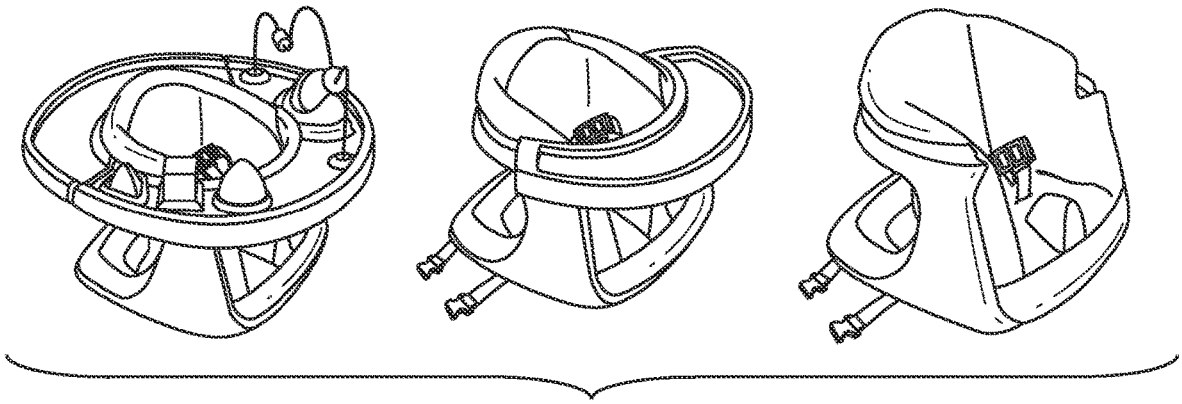
FIG. 5 illustrates three configurations of the multi-stage infant activity center of FIG. 1.

Referring now to FIG. 5, three configurations of the multi-stage infant activity center 100 are illustrated. In a first configuration, the multi-stage infant activity center 100 includes a play and feeding tray. In this first configuration, the tray can rotate 360° while the seat can only be used as positioner.

In a second configuration, the multi-stage infant activity center 100 includes just a feeding tray that is fixed in front. In this configuration, the seat can be used as positioner and booster.

In a third configuration, the multi-stage infant activity center 100 does not include a tray. In this configuration, the seat can be used as positioner and booster.

Figure 6A:
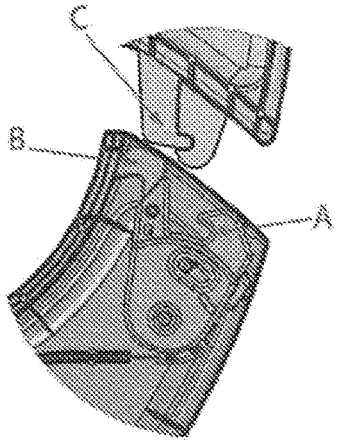
FIG. 6A, FIG. 6B and FIG. 6C illustrate the dual function latch mechanism.
Figure 6B:
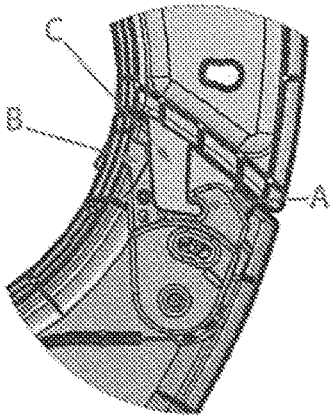
Figure 6C:
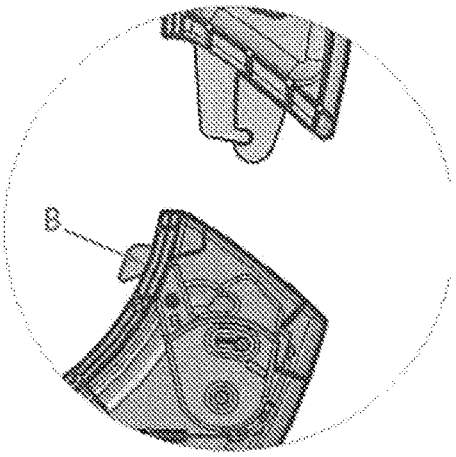

Referring now to FIG. 6A, FIG. 6B and FIG. 6C, the latching mechanism (also referred to as a "dual function latch mechanism") is shown in detail.

As shown in FIG. 6A, latch hook (A) and latch hook (B) are pulled back to release from play tray or seat.

As shown in FIG. 6B, latch hook (A) engages with play tray tab (C). Latch hook (B) is held back so the tray assembly can spin.

As shown in FIG. 6C, latch hook (B) is fully engaged with the seat.

Figure 7:
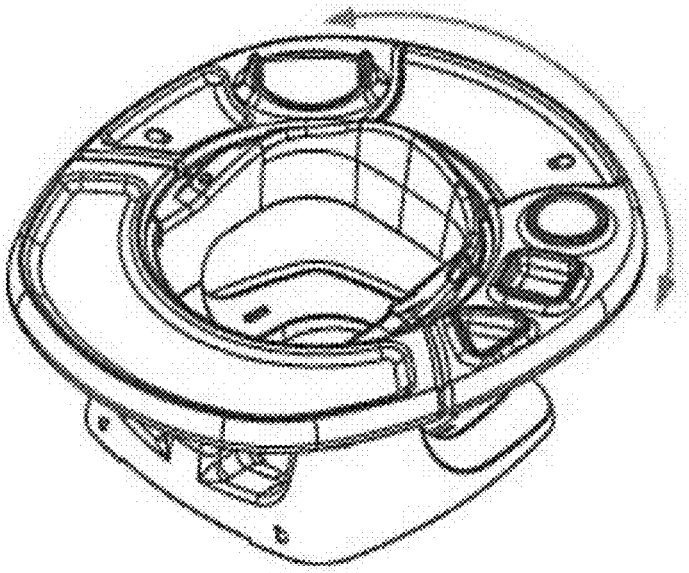
FIG. 7 illustrates how the tray may rotate 360° about the seat.

FIG. 7 illustrates how the tray may rotate 360° about the seat.

Figure 8:
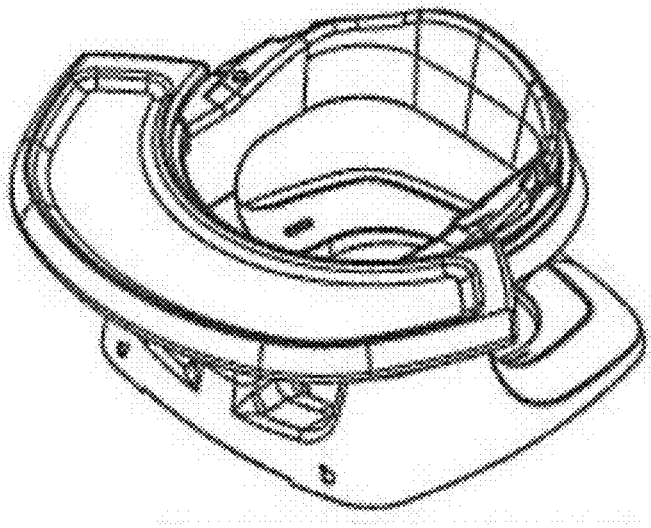
FIG. 8 illustrates how the tray works in booster and positioner mode.

FIG. 8 illustrates how the tray works in booster and positioner mode.

Figure 9:
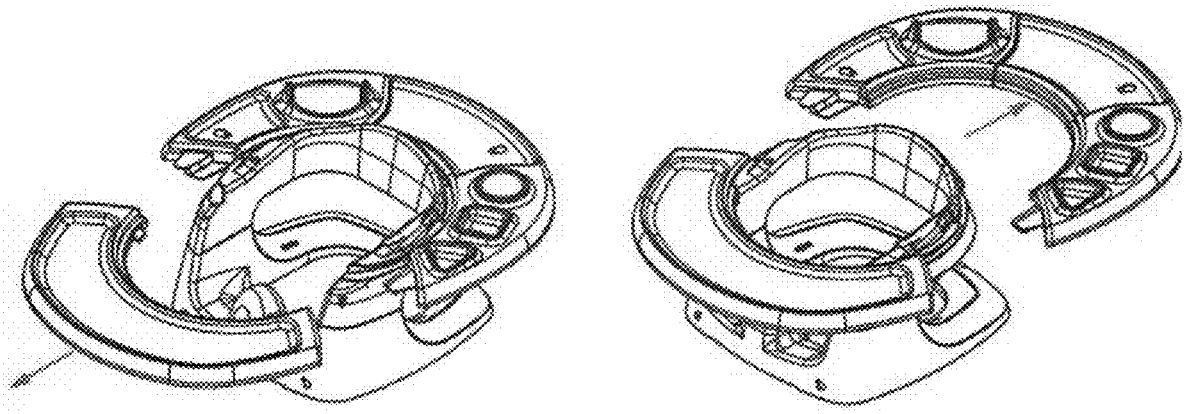
FIG. 9 illustrates how a front and/or rear portion of the tray may be removed from the seat.

FIG. 9 illustrates how a front and/or rear portion of the tray may be removed from the seat.

Figures 10A, 10B:
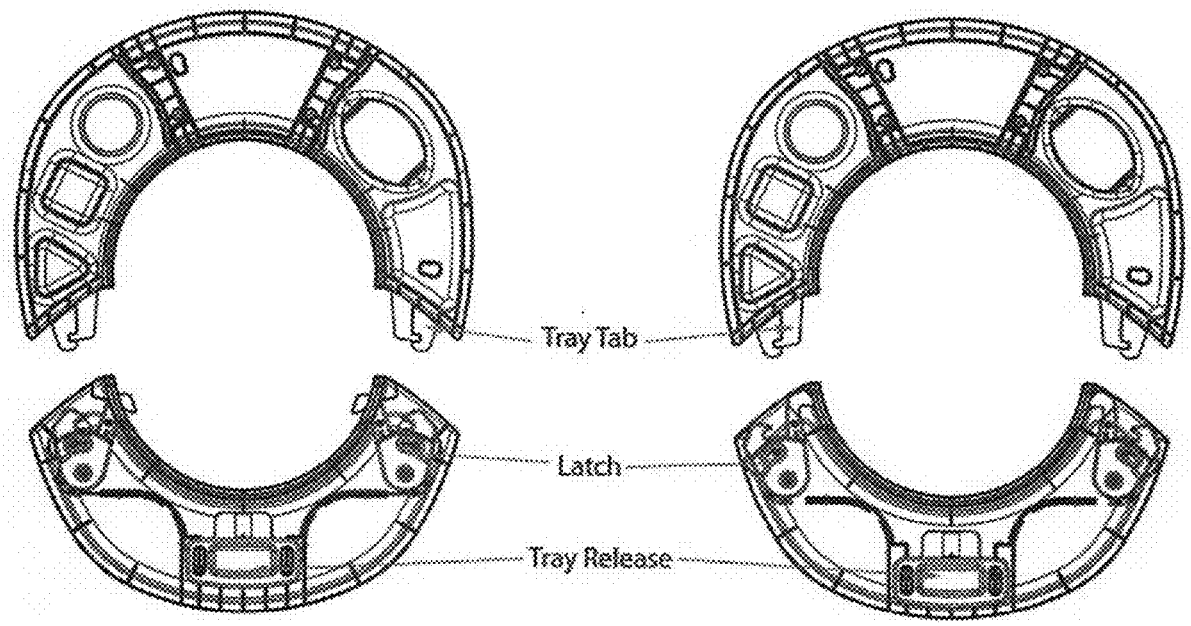
FIG. 10A illustrates the tray release back—latches in closed position.
FIG. 10B illustrates the tray release forward—latches in open position.

FIG. 10A illustrates the tray release back—latches in closed position.

FIG. 10B illustrates the tray release forward—latches in open position.

The disclosed examples provide specific combinations of parts, components, features, and aspects. It is within the scope of the present disclosure and claims to permit different combinations of those parts, components, features, and aspects. It is possible that any one or more of the disclosed parts, components, features, and aspects of the activity center can be used separately or in combination with any other one or more of the disclosed parts, components, features, and aspects.

Although certain activity center seats, latch system, latch mechanism, and other components and methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An apparatus comprising:

a hard plastic booster seat;

a soft foam insert positioned inside the hard plastic booster seat; and a semi-circular tray removeably affixed to an upper channel of a top portion of the hard plastic booster seat, the tray comprising at least one section configured to be locked into the upper channel with a dual function latch mechanism, wherein the tray is configured to rotate 360 degrees about the hard plastic booster seat.

2. The apparatus of claim 1 wherein the dual function latch mechanism comprises a pair of latch hooks that release from tray or seat when pulled back.

3. The apparatus of claim 1 wherein the dual function latch mechanism comprises a first latch hook and a second latch hook, the first latch hook engaged to a tray tab and the second latch hook held back so the tray can spin.

4. The apparatus of claim 1 further comprising:

an adjustable three-point harness affixed to a center of a seating position of the hard plastic booster seat for securing an occupant.

5. The apparatus of claim 1 further comprising:

a securing strap or band placed through lower apertures in a lower portion of the hard plastic booster seat to secure the hard plastic booster seat to a chair.

6. An apparatus comprising:

a solid base;

a soft insert configured to fit within the base;

a harness affixed to the solid base and passing through a center of the soft insert; and a removable tray slideably fixated in an outer channel of an upper portion of the solid base and secured by a dual function latch mechanism, wherein the tray is configured to rotate about the solid base.

7. The apparatus of claim 6 wherein the tray comprises one of more sections and includes one or more items.

8. The apparatus of claim 7 wherein the items comprises infant's toys.

9. The apparatus of claim 6 further comprising a securing strap or band placed through lower apertures in a lower portion of the base to secure the base to a chair.

10. The apparatus of claim 6 wherein the dual function latch mechanism comprises a pair of latch hooks that release from tray or base when pulled back.

11. An apparatus comprising:

a solid base;

a soft insert configured to fit within the base;

a harness affixed to the solid base and passing through a center of the soft insert; and a removable tray slideably fixated in an outer channel of an upper portion of the solid base and secured by a dual function latch mechanism;

wherein the dual function latch mechanism comprises a first latch hook and a second latch hook, the first latch hook engaged to a tray tab and the second latch hook held back so the tray can spin about the base.

* * * * *